US011143132B2

(12) United States Patent
Serrecchia

(10) Patent No.: US 11,143,132 B2
(45) Date of Patent: Oct. 12, 2021

(54) ALERTING METHOD FOR PREDICTIVE MAINTENANCE OF A HIGH-PRESSURE PUMP IN AN INTERNAL COMBUSTION ENGINE

(71) Applicants: CONTINENTAL AUTOMOTIVE FRANCE, Toulouse (FR); CONTINENTAL AUTOMOTIVE GMBH, Hanovre (DE)

(72) Inventor: Philippe Serrecchia, Villefranche de Lauragais (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 16/770,802

(22) PCT Filed: Nov. 16, 2018

(86) PCT No.: PCT/FR2018/052883
§ 371 (c)(1),
(2) Date: Jun. 8, 2020

(87) PCT Pub. No.: WO2019/110883
PCT Pub. Date: Jun. 13, 2019

(65) Prior Publication Data

US 2020/0332739 A1 Oct. 22, 2020

(30) Foreign Application Priority Data

Dec. 8, 2017 (FR) ..... 1761812

(51) Int. Cl.
*F02D 41/22* (2006.01)
*F02D 1/00* (2006.01)
(Continued)

(52) U.S. Cl.
CPC ..... *F02D 41/221* (2013.01); *F02D 1/00* (2013.01); *F02D 41/042* (2013.01); *F02D 41/38* (2013.01);
(Continued)

(58) Field of Classification Search
CPC ..... F02D 41/221; F02D 1/00; F02D 41/042; F02D 41/38; F02D 2001/007;
(Continued)

(56) References Cited

U.S. PATENT DOCUMENTS 8,240,290 B2 * 8/2012 Miyake ..... F02D 41/3836 123/446
9,279,404 B2 * 3/2016 Aoki ..... F02M 63/0205
(Continued)

FOREIGN PATENT DOCUMENTS

DE 102008043861 A1 5/2010
DE 102009003236 A1 11/2010
DE 102012021428 A1 4/2014

OTHER PUBLICATIONS

International Search Report, dated Mar. 19, 2019, from corresponding PCT application No. PCT/FR2018/052883.

*Primary Examiner* — Joseph J Dallo
(74) *Attorney, Agent, or Firm* — Nixon & Vanderhye

(57) ABSTRACT

Disclosed is a method of alerting to the state of a high-pressure pump of an engine including a relief valve, a threshold pressure defining the opening pressure of the relief valve, the pump supplying fuel under pressure to a chamber equipped with a pressure sensor, including the following steps: initializing a computer when the engine is cut off during which cut-off a threshold pressure and a value of a first counter are collected in a memory associated with the computer; measuring the pressure of the fuel in the chamber; incrementing the first counter if the pressure of the fuel in
(Continued)

the chamber is above or equal to the threshold pressure; and triggering an alert when the value of the first counter crosses a predetermined threshold.

19 Claims, 3 Drawing Sheets

(51) Int. Cl.
*F02D 41/04* (2006.01)
*F02D 41/38* (2006.01)
*G07C 5/08* (2006.01)

(52) U.S. Cl.
CPC ..... *G07C 5/085* (2013.01); *G07C 5/0816* (2013.01); *F02D 2001/007* (2013.01); *F02D 2001/009* (2013.01); *F02D 2041/224* (2013.01); *F02D 2200/021* (2013.01); *F02D 2200/0602* (2013.01); *F02D 2200/101* (2013.01); *F02D 2200/70* (2013.01)

(58) Field of Classification Search
CPC ..... F02D 2001/009; F02D 2041/224; F02D 2200/021; F02D 2200/0602; F02D 2200/101; F02D 2200/70; F02D 41/3863; G07C 5/0816; G07C 5/085
See application file for complete search history.

(56) References Cited

U.S. PATENT DOCUMENTS

2006/0075992 A1* 4/2006 Akita ..... F02M 53/04 123/431
2009/0240417 A1* 9/2009 Fushiki ..... F02M 65/003 701/103
2011/0160981 A1 6/2011 Rieger et al.
2014/0216407 A1 8/2014 Smith
2015/0285166 A1* 10/2015 Surnilla ..... F02D 19/084 123/294
2016/0153385 A1* 6/2016 Pursifull ..... F02M 63/0285 123/299
2017/0248096 A1* 8/2017 Zeng ..... F02M 63/025
2018/0328304 A1* 11/2018 Pursifull ..... F02D 41/3854
2018/0328306 A1* 11/2018 Pursifull ..... F02D 41/2467

* cited by examiner

ALERTING METHOD FOR PREDICTIVE MAINTENANCE OF A HIGH-PRESSURE PUMP IN AN INTERNAL COMBUSTION ENGINE

BACKGROUND OF THE INVENTION

Field of the Invention

The present invention relates to an alerting method for predictive maintenance of a high-pressure pump in an internal combustion engine.

The present invention relates more particularly to a fuel pump for supplying an injection common rail of an internal combustion engine. Fuel is therefore stored at high pressure in a rail which supplies injectors: all that is then required in order to be able to send fuel under pressure into a cylinder is for an injector to open.

Description of the Related Art

For the injection to work correctly, the pressure in the injection rail needs to be kept as constant as possible. The high-pressure pump used to pressurize the rail is fitted with a relief valve (or Pressure Relief Valve, PRV). This valve is triggered (opens) when the fuel pressure becomes too high.

In an engine, if the high-pressure fuel pump has broken down, or even if it is operating in a downgraded mode, it is obvious that the entire operation of the engine is affected. Specifically, if the pressure in the injection rail is not the nominal pressure, the injection of fuel into the engine does not take place under the optimal operating conditions intended for the engine, the fuel therefore does not burn normally in the cylinders and the expected performance (both in terms of the torque delivered and in terms of pollution) is not achieved.

SUMMARY OF THE INVENTION

It is therefore one object of the present invention to avoid such a situation arising and therefore to avoid a breakdown caused by a failure of the high-pressure pump provided for the fuel.

It has been assumed, and then observed, that when the relief valve of a high-pressure fuel pump is activated too often, the efficiency of the corresponding pump decreases and the pump is no longer capable of delivering the desired flow and/or pressure. The engine is therefore obliged to operate in a downgraded mode, and the pump has to be changed. The opening pressure of the relief valve (the PRV) is never, or very seldom, reached when the engine is operating, because it is a safety relief valve the frequent operation of which when the engine is running is not anticipated. Frequent openings of this valve may be considered to be destructive because of the frequent stress loadings placed on the spring. On the other hand, when the engine is shut down, there is generally an increase in pressure in the high-pressure rail (the fuel chamber) because of a temporary temperature rise that occurs before the engine cools, because of the fact that the engine cooling has switched off. The method according to the application being examined counts these openings of the relief valve.

It is therefore another object of the present invention to determine an imminent breakdown of the pump and/or to provide an alert inviting a change of pump before the latter breaks down (or before it begins to operate less effectively).

Furthermore, the exact pressure at which the relief valve is triggered is not known to the engine control means. This is because this pressure is dependent on the manufacturing tolerances of this relief valve and cannot therefore be known beforehand by the engine controller.

It is therefore another object of the present invention to determine the pressure that triggers the opening of the relief valve.

To this end, the present invention proposes a method of alerting to the state of a high-pressure pump of an engine comprising a relief valve, a threshold pressure defining the opening pressure of the relief valve, said pump supplying fuel under pressure to a chamber equipped with a pressure sensor, characterized in that it comprises the following steps:

- initializing a computer when the engine is cut off during which cut-off said threshold pressure and a value of a first counter are collected in a memory associated with said computer,
- measuring the pressure of the fuel in the chamber,
- incrementing the first counter if the pressure of the fuel in the chamber is above or equal to the threshold pressure,
- triggering an alert when the value of the first counter crosses a predetermined threshold.

This method thus makes it possible to determine in advance when a high-pressure pump needs to be changed, and to do so, more often than not, before that pump breaks down. Not all breakdowns can be avoided, particularly sudden failures, but most can.

The method is ended for example when an alert is triggered or else when a succession of a predetermined number of measurements yield each time a decreasing value for the pressure in the chamber.

An alerting method as defined hereinabove may also make provision for an alert also to be triggered when a succession of a predetermined number of measurements yield each time a pressure value increasing above the threshold pressure. In that case, a breakdown is detected (rather than predicted).

In order to render the count of the number of openings of the relief valve more accurate, the value of the opening pressure of this valve may for example be refined. For example, provision may be made for the threshold pressure stored in memory to be determined when the engine is cut off, under predetermined conditions, by performing the following steps:

- successively measuring the pressure in the chamber, and
- storing in memory the first measured pressure corresponding to a decrease in the pressure in comparison with the pressure measured during the previous pressure measurement, this first measured pressure then being considered as being the threshold pressure to be taken into consideration for a method as described above.

In this way of determining the opening pressure of the relief valve it is possible, in one preferred embodiment, to make provision for the predetermined conditions for determining the threshold pressure to be as follows:

- pressure in the chamber above a predetermined pressure, and
- temperature of an engine coolant above a predetermined temperature, and
- temperature of the chamber supplied by the pump below a given temperature, and
- ambient temperature above a predetermined temperature.

Alternatively or cumulatively, the threshold pressure stored in memory may be determined with the engine running, under predetermined conditions, by performing the following steps:

introducing into an engine control and management system a setpoint pressure for the chamber supplied by the high-pressure pump, said setpoint pressure being higher than the theoretical maximum pressure triggering the relief valve, successively measuring the pressure in the chamber, and storing in memory the first measured pressure corresponding to a decrease in the pressure in comparison with the pressure measured during the previous pressure measurement, this first measured pressure then being considered as being the threshold pressure to be taken into consideration for an alerting method above.

In this variant of the alerting method, the predetermined conditions for determining the threshold pressure may be as follows:

fuel supply to the cylinders cut off, and temperature of an engine coolant below a predetermined temperature, and engine speed below a predetermined speed, and ambient temperature above a predetermined temperature.

The present invention also relates to:

an engine control and management device comprising means for implementing each of the steps of a method described hereinabove, and/or an engine comprising such a control and management device.

BRIEF DESCRIPTION OF THE DRAWINGS

Details and advantages of the present invention will become more clearly apparent from the description that follows, supported by the appended schematic drawing in which.

DESCRIPTION OF THE PREFERRED EMBODIMENTS

Figure 1:
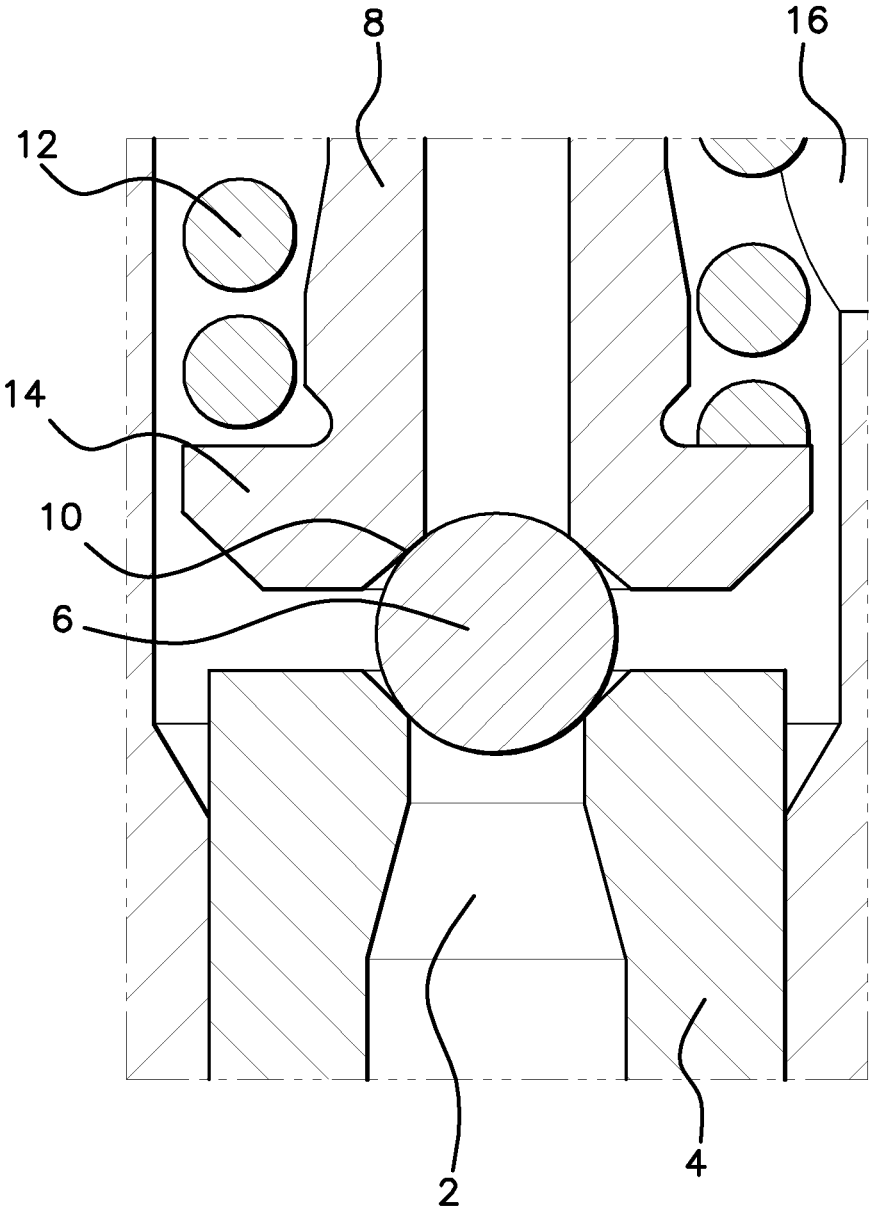
FIG. 1 illustrates a view in longitudinal section of a relief valve.

FIG. 1 illustrates, purely by way of nonlimiting illustration, a relief valve (known from the prior art) which can be used in conjunction with a high-pressure pump intended to pump fuel (for example gasoline) into an internal combustion engine, for example an engine for a motor vehicle. The high-pressure pump delivers high-pressure fuel to a chamber, also commonly referred to as a rail, for supplying injectors. The chamber is common to several injectors. These injectors are therefore always under pressure and in order to supply a corresponding cylinder with fuel, all that is necessary is to open these injectors.

The high-pressure pump is, for example, associated with the relief valve illustrated in FIG. 1. Such a valve is also known by its acronym PRV which stands for Pressure Relief Valve (the full name for the relief valve). A high-pressure outlet of the pump supplies fuel to a duct 2 formed in a body 4. A ball 6 closes the duct 2. The ball is preloaded into the position in which the duct 2 is closed by a hollow rod 8 in which there is formed a seat 10 accepting the ball 6 and by a spring 12 which bears against a head 14 of the rod 8. When the rod 8 moves away from the body 4, it opens access to a discharge duct 16 for the fuel that initially was in the duct 2.

In order for the relief valve to open, the fuel coming from the high-pressure pump needs to exert on the ball 6 and on the head 14 of the rod 8 a force that is higher than that exerted on these elements by the spring and the fuel that is in the relief chamber.

The fuel exerts on the ball 6 and the head 14 a pressure force and forces connected with the viscosity of the fuel. Opposing these forces are the forces exerted, on the one hand, by the spring 12 and, on the other hand, by the fuel that is situated on the side of the discharge duct 16. The forces exerted by the spring 12 are the force exerted by the spring in its rest position and the force exerted by the compression of the spring (which is equal to the spring stiffness multiplied by the variation in spring length). The forces exerted by the fuel are pressure forces and forces connected with the viscosity of the fuel. Because the pressure on the side of the discharge duct is substantially constant, the opening of the relief valve will be essentially dependent on the pressure of the fuel in the duct 2, namely the pressure of the fuel which is delivered by the high-pressure pump.

Figure 2:
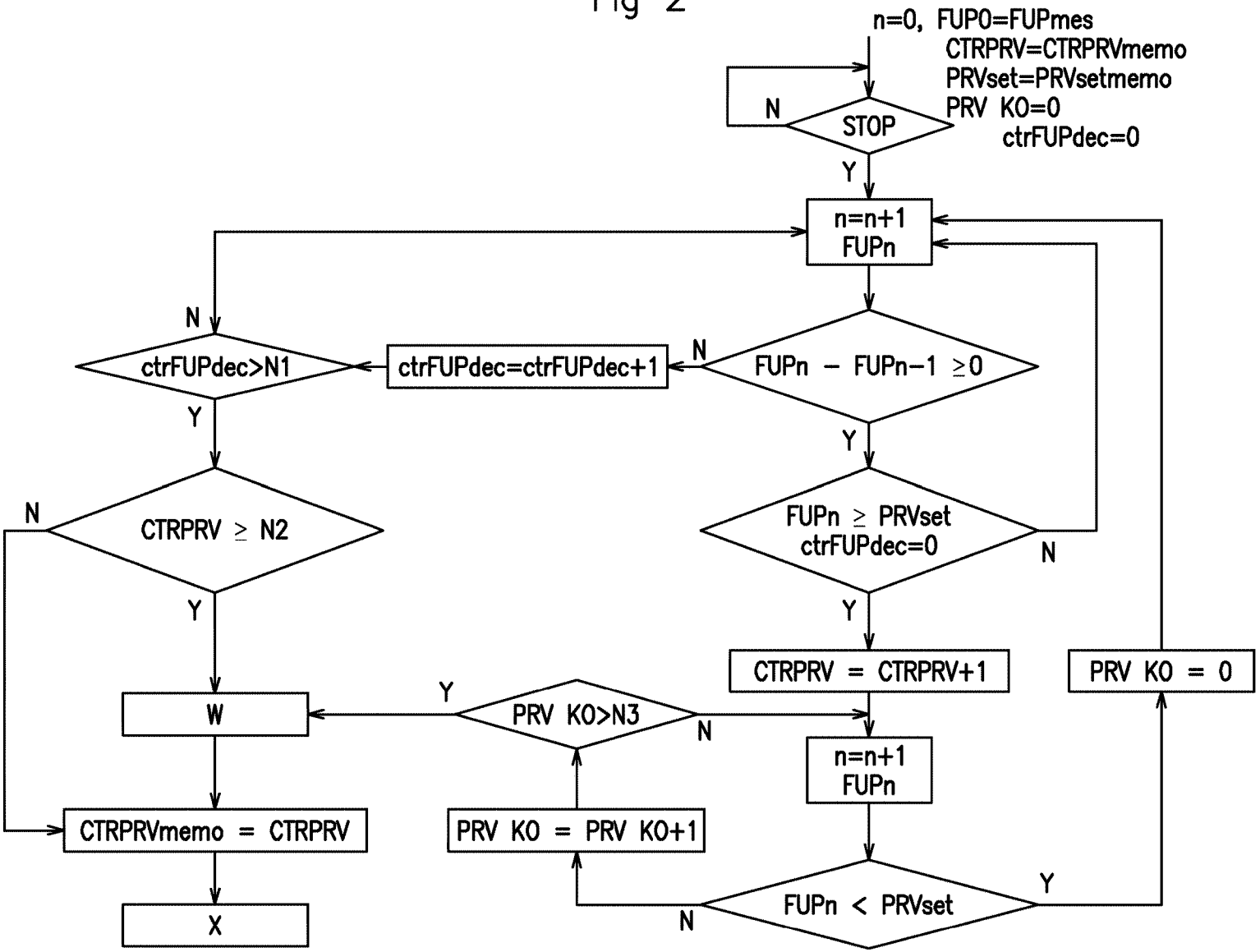
FIG. 2 is a flow diagram of one preferred embodiment of an alerting method.

FIG. 2 illustrates a preferred embodiment of a method for creating an alert before a high-pressure fuel pump in an engine fails, and in certain failure modes. This flow diagram is intended to be run by one of the computers present in an engine for engine control and management.

Figure 4:
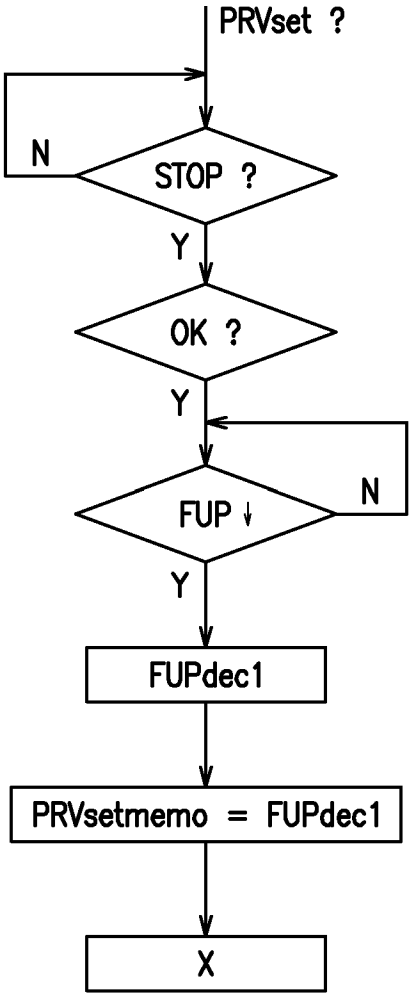
FIG. 4 is a flow diagram of one preferred embodiment of another way of determining a threshold pressure used in the flow diagram of FIG. 2.
Figure 3:
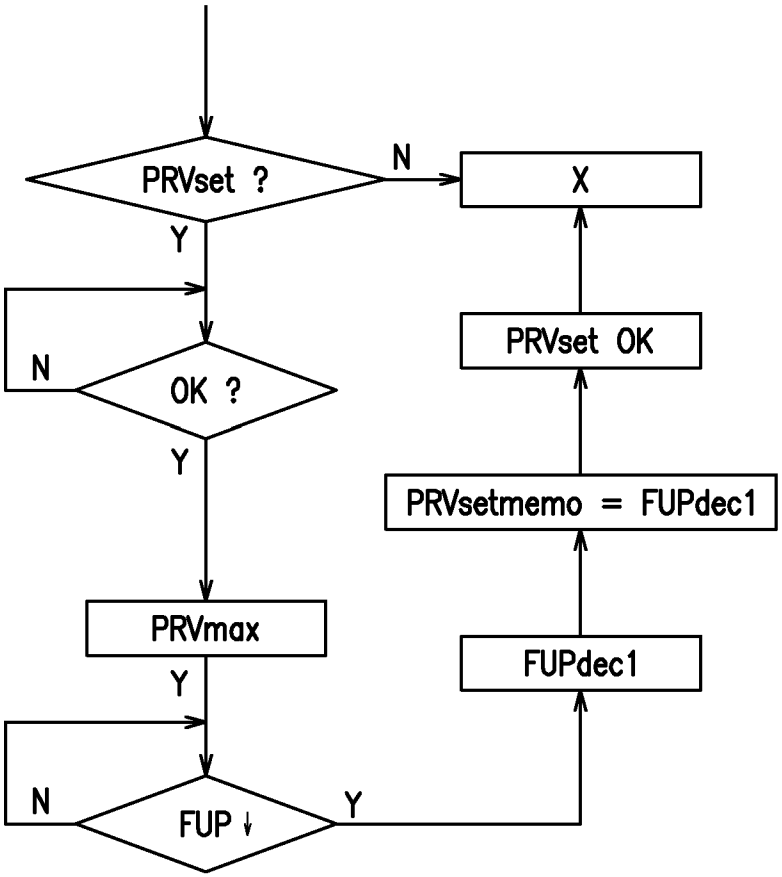
FIG. 3 is a flow diagram of one preferred embodiment of how to determine a threshold pressure used in the flow diagram of FIG. 2.

In the flow diagrams of FIGS. 2 to 4, the letter N is used for "no" and the letter Y for "yes".

The first decision box (FIG. 2) "STOP" relates to the status of the engine. As long as the engine is running, the method does not function. It begins when the engine is stopped. In order to determine whether or not the engine is running, it is possible to look at whether the engine ignition switch is open or closed, or else it is possible to look at the rotational speed of the engine.

When engine stop is detected, a number of parameters are initialized:

an increment n is set to 0, the pressure of the fuel acting on the relief valve is measured, and this measurement FUPmes is stored in memory as an initial fuel pressure value FUP0. The successive fuel-pressure measurements will be termed FUPn hereinafter, with n being incremented upon each measurement, an increment CTRPRV which counts the number of activations of the relief valve is collected in the memory in which it was recorded at the last implementation of the method. Thus, CTRPRV adopts the value CTRPRVmemo which has been stored in memory. When this method is run for the first time in an engine, CTRPRVmemo can for example be set to 0 (any other value may also be chosen), the value PRVset of the pressure that triggers the opening of the relief valve may vary over time. FIGS. 3 and 4 illustrate two methods that allow this value to be learned. At the end of such learning, the determined value PRVsetmemo is stored in memory. When no learning has been performed, the value PRVsetmemo corresponds to a theoretical maximum value at which the relief valve is to open. For example, if, by construction, the relief valve is to open for a pressure P0±α, then PRVsetmemo will for example be initialized to P0+α, or else to a value slightly higher than this value, by a few bar, an increment PRV KO is initialized to 0. This increment will be used to detect a breakdown of the pump when the pressure continues to increase even though the relief valve triggering pressure has been reached, and an increment ctrFUPdec is initialized to 0. This increment will be used to end the method in most cases, namely when no alert is emitted.

When engine stop is detected and the initializations have been performed, the increment n is incremented by one value and a fuel pressure measurement FUPn is taken.

First of all, this new measured value is compared with the value measured previously (the last previous one): FUPn−FUPn−1≥0.

If a decrease in the pressure is observed, the increment ctrFUPdec is incremented. As long as the value of this increment does not exceed a predetermined value N1, further measurements are taken. When the value N1+1 is reached, the increment CTRPRV, which counts the number of openings of the relief valve, is checked. Usually, this increment is below the threshold N2 for the critical number of openings. In that case, the current value of CTRPRV is stored in memory and becomes the new value CTRPRVmemo that will be used for the next running of this method. A step "X" then corresponds to the end of the method. During this step, the request to keep active the computer that handles the running of the present method is notably terminated.

If, on the other hand, the increment CTRPRV is higher than the threshold N2, an alert is triggered in step "W". After this step, the current value of CTRPRV is likewise stored in memory and the method is ended as explained in the previous paragraph.

Consider now the event in which the fuel pressure measurement is increasing. This is what generally happens when the engine stops. This is because the fuel is stored in the rail. Given the temperature of the engine, the temperature in the rail has a tendency to increase, and the pressure in the rail therefore increases. In such an event, it is necessary to look at whether the pressure value FUPn that has been measured crosses the threshold PRVset. In parallel, because the pressure is increasing, the increment ctrFUPdec which totals the number of successive decreasing measurements is set to 0.

If the threshold is not reached, a new measurement is taken, and the increment n is incremented.

If the threshold is reached, the relief valve opens and the increment CTRPRV is incremented.

The increment n is then incremented again and a further fuel pressure measurement is taken. If the fuel pressure has dropped back below the limit pressure PRVset, then a further measurement is started with a new increment n and with the increment PRV KO set to 0. On the other hand, if the fuel pressure remains above the value PRVset, the increment PRV KO which, in a similar way to the increment ctrFUPdec, which counts the successive measurements with decreasing pressures, counts the successive pressure measurements which are higher than the pressure PRVset, is incremented. As long as the value of this increment remains below a limit N3, further pressure measurements are taken and PRV KO is incremented as long as the measured pressure remains above the limit pressure PRVset.

If the limit N3 is reached (this number is fixed according to the frequency of the fuel pressure measurements and the characteristics of the pump and of the relief valve), an alert is triggered (step W). This is because, in such an instance, the relief valve is remaining abnormally closed and is therefore able to perform its function. This anomaly is then signaled through an alert.

Once the alert has been triggered, the alert procedure is terminated. As indicated hereinabove, the current value of CTRPRV is stored in the memory and the request to keep activated the computer that manages the running of the present method is terminated (step "X").

This method thus makes it possible to trigger an alert, on the one hand, when the relief valve opens N2 times and, on the other hand, when the relief valve of the high-pressure pump is no longer able to perform its function.

FIG. 3 illustrates one way of determining the limit value PRVset, which corresponds to the fuel pressure that triggers the opening of the relief valve. As indicated above, an initial value (engine new) is stored in memory at the outset and corresponds to a theoretical maximum value.

First of all, it is appropriate to determine whether or not the value of the relief valve opening pressure needs to be determined ("PRVset?"). If this value has been determined "recently", there is no need to do so. This is because this value changes with the mechanical wearing of the parts and with the changes to the value of the stiffness of the spring 12. The conditions for a new determination of the value of this opening pressure are predefined according to criteria that are to be established. By way of simply illustrative and nonlimiting examples, it is possible for example to anticipate performing a new calibration every n thousand kilometers, or else every six months, or a combination of these parameters.

If the relief valve opening pressure does need to be determined, this determining can be done only once external conditions, which will have been defined beforehand, are themselves likewise met. In the case illustrated in FIG. 3, it is therefore proposed that the relief valve opening pressure be redefined if the engine is in a mode of operation in which the supply of fuel to the cylinders is cut off and the following three conditions are met:

the temperature of the engine coolant is low: for example (illustrative and nonlimiting as with all the values in the present description) below 40° C.;

the engine speed is low (for example under 3000 rpm for a so-called gasoline engine)

the ambient temperature is low (for example below 10° C.).

In summary, the determination will be made with the engine cold, at low speed. The idea is therefore to force the pump to supply the injection rail with fuel and to look at when the relief valve opens. That is featured in the flow diagram of FIG. 3 as explained hereinafter.

In this FIG. 3, when the relief valve opening value needs to be determined, on the one hand, and the external parameters are met, on the other hand, then the setpoint value of the high-pressure pump is changed so that it is above the opening pressure of the relief valve. This may for example be the pressure P0+α mentioned above, or else a pressure higher than the latter. Other strategies may be chosen here (for example adopting the last known pressure PRVset and increasing it by 20 bar, etc.). In this way, the pump is forced to deliver fuel to the high-pressure rail. By then taking fuel-pressure measurements, the pressure is monitored in order to determine the first measured pressure value that is lower than the previous measurement, termed FUPdec1. Here again, the strategy may differ slightly. For example, it is possible to choose the maximum value of the measured pressure. It is also possible, from the measured values, to determine a curve (for example using the least-squares method) and to determine an opening value from this curve.

Once the value is determined (in FIG. 3 it is assumed that this is FUPdec1), this value is stored in memory and therefore becomes PRVsetmemo, which will be used for the next running of the method illustrated in FIG. 2. The value of the opening pressure PRVset is thus determined and the learning process can be terminated.

The method illustrated in FIG. 4 is another procedure that can be used to determine the relief valve opening pressure. This method does not replace that of FIG. 3. The two methods can be implemented in the one same engine. As is evident from what follows, these methods cannot be conducted in parallel because the implementation conditions are not the same. One or the other of these two methods can then be implemented, depending on the external conditions.

First of all, it is appropriate to determine whether or not the value of the relief valve opening pressure needs to be determined ("PRVset?"). These conditions are preferably the same as those listed with reference to FIG. 3. Once the predetermined conditions have been met, the processor is on standby to determine which of the conditions of FIG. 3 or of FIG. 4 (see below) are the first to be met.

Let us therefore assume here that the relief valve opening pressure does need to be determined. In the case illustrated in FIG. 4, it is proposed that the relief valve opening pressure be redefined if the engine is stopped and if the following four conditions are met:

- the temperature of the engine coolant is high: for example (illustrative and nonlimiting as with all the values in the present description) above 90° C.;
- the fuel pressure is already high: for example higher than 350 bar;
- the ambient temperature is high (for example above 30° C.);
- the temperature of the fuel in the rail is relatively low (for example below 50° C.).

In summary, the determination will be performed with the engine hot, when it is hot outside and the fuel is not too hot. The idea is then that the fuel pressure will increase (and even do so fairly rapidly) because it is not very hot but is placed in a hot environment. Because the fuel pressure is fairly high to start with, it then ought to exceed the relief valve opening pressure value. The rise in pressure in the fuel rail is then observed and the pressure as soon as a drop in pressure is identified is recorded. This drop can be due only to an opening of the relief valve. That is featured in the flow diagram of FIG. 4 as explained hereinafter.

In this FIG. 4, when the relief valve opening value needs to be set (determination of PRVset), on the one hand, and the external parameters are met, on the other hand, fuel pressure measurements are then conducted and the variations in this pressure are monitored in order to determine the first measured pressure value that is below the previous measurement, termed FUPdec1. Here again, the strategy may differ slightly. For example, it is possible to choose the maximum value of the measured pressure. It is also possible, from the measured values, to determine a curve (for example using the least-squares method) and to determine an opening value from this curve.

Once the value is determined (in FIG. 4 it is assumed that this is FUPdec1), this value is stored in memory and therefore becomes PRVsetmemo, which will be used for the next running of the method illustrated in FIG. 2. The value of the opening pressure PRVset is thus determined and the learning process can be terminated (step X).

The above description therefore first of all makes it possible to determine the fuel pressure that triggers the opening of the relief valve associated with the high-pressure pump intended to pump said fuel in a rail supplying injectors. Next, an alerting method is proposed, so as to be able to provide a warning and elicit predictive maintenance of the high-pressure fuel pump.

Implementation of the above methods therefore in most cases makes it possible to avoid a breakdown of the fuel pump which leads to a serious breakdown, i.e. the stopping of the vehicle or at the very least its operation in very downgraded mode (with engine speed and torque limited). Thanks to the alert emitted, the component can be changed before the breakdown occurs and this breakdown can therefore be avoided.

The learning procedures described and illustrated allow the best customization of the relief valve opening pressure value. In that way, the alerting method can be implemented more effectively and more precisely. Precise knowledge of this opening pressure is also of great utility in refining the engine control strategies.

Of course, the present invention is not limited to the embodiments described above and illustrated in the attached drawing or to the variant embodiments mentioned, but also covers embodiment variants within the competence of those skilled in the art.

The invention claimed is:

1. A method for monitoring a state of a high-pressure fuel pump of an engine and generating a warning related thereto, where the pump is equipped with a relief valve and is configured for supplying fuel under pressure to a chamber equipped with a pressure sensor, a threshold pressure defining an opening pressure of the relief valve, the method comprising:

- upon cut-off of the engine, initializing a computer, during which said threshold pressure and a value of a first counter are stored in a non-transitory memory in communication with said computer;
- measuring via the pressure sensor a pressure of fuel in the chamber;
- incrementing the value of the first counter by one with each occurrence of said measuring yielding a result where the pressure of the fuel in the chamber is above or equal to the threshold pressure; and
- triggering an alert when the value of the first counter crosses a predetermined threshold.

2. The alerting method as claimed in claim 1, wherein the method terminates when the alert is triggered and also when a succession of a predetermined number of measurements each yield a decreasing value for the pressure in the chamber.

3. The alerting method as claimed in claim 1, wherein the alert is also triggered when a succession of a predetermined number of measurements each yield a pressure value increasing above the threshold pressure.

4. The alerting method as claimed in claim 1, wherein under predetermined conditions the threshold pressure that is stored in the memory upon cut-off of the engine is determined by performing the following steps:

- successively measuring the pressure of the fuel in the chamber, and
- storing in the memory, as the threshold pressure, a first measured pressure corresponding to a decrease in the pressure of the fuel in comparison with a measured pressure that is measured during a previous pressure measurement.

5. The alerting method as claimed in claim 4, wherein the predetermined conditions for determining the threshold pressure are as follows:

- the pressure in the chamber is above a predetermined pressure, a temperature of an engine coolant is above a predetermined maximum temperature, a temperature of the chamber supplied by the pump is below a given minimum temperature, and an ambient temperature is above a predetermined ambient threshold temperature.

6. The alerting method as claimed in claim 1, wherein under predetermined conditions the threshold pressure that is stored in the memory is determined, with the engine running, by performing the following steps:

introducing into an engine control and management system a setpoint pressure for the chamber supplied by the pump, said setpoint pressure being higher than a theoretical maximum pressure for triggering the relief valve, successively measuring the pressure in the chamber, and storing in the memory, as the threshold pressure, a first measured pressure corresponding to a decrease in the pressure in comparison with a pressure measured during a previous pressure measurement.

7. The alerting method as claimed in claim 6, wherein the predetermined conditions for determining the threshold pressure are as follows:

fuel supply to the cylinders is cut off, a temperature of an engine coolant is below a predetermined temperature, engine speed is below a predetermined speed, and an ambient temperature is above a predetermined temperature.

8. An engine control and management device for monitoring a state of a high-pressure fuel pump of an engine and for generating a warning related thereto, where the pump is equipped with a relief valve and is configured for supplying fuel under pressure to a chamber equipped with a pressure sensor, a threshold pressure defining an opening pressure of the relief valve, said device comprising a computer configured to:

upon cut-off of the engine, collect and store said threshold pressure and a value of a first counter in a non-transitory memory in communication with said computer;

measure via the pressure sensor a pressure of fuel in the chamber;

increment the value of the first counter by one with each occurrence of said measuring yielding a result where the pressure of the fuel in the chamber is above or equal to the threshold pressure; and trigger an alert when the value of the first counter crosses a predetermined threshold.

9. An internal combustion engine, comprising:

a control and management device for monitoring a state of a high-pressure fuel pump of the engine and for generating a warning related thereto, where the pump is equipped with a relief valve and is configured for supplying fuel under pressure to a chamber equipped with a pressure sensor, a threshold pressure defining an opening pressure of the relief valve, and the control and management device including a computer configured to:

upon cut-off of the engine, collect and store said threshold pressure and a value of a first counter in a non-transitory memory in communication with said computer;

measure via the pressure sensor a pressure of fuel in the chamber;

increment the value of the first counter by one with each occurrence of said measuring yielding a result where the pressure of the fuel in the chamber is above or equal to the threshold pressure; and trigger an alert when the value of the first counter crosses a predetermined threshold.

10. The alerting method as claimed in claim 2, wherein the alert is also triggered when a succession of a predetermined number of measurements each yield a pressure value increasing above the threshold pressure.

11. The alerting method as claimed in claim 2, wherein under predetermined conditions the threshold pressure that is stored in the memory upon cut-off of the engine is determined by performing the following steps:

successively measuring the pressure of the fuel in the chamber, and storing in the memory, as the threshold pressure, a first measured pressure corresponding to a decrease in the pressure of the fuel in comparison with a measured pressure that is measured during a previous pressure measurement.

12. The alerting method as claimed in claim 3, wherein under predetermined conditions the threshold pressure that is stored in the memory upon cut-off of the engine is determined by performing the following steps:

successively measuring the pressure of the fuel in the chamber, and storing in the memory, as the threshold pressure, a first measured pressure corresponding to a decrease in the pressure of the fuel in comparison with a measured pressure that is measured during a previous pressure measurement.

13. The alerting method as claimed in claim 2, wherein under predetermined conditions the threshold pressure that is stored in the memory is determined, with the engine running, by performing the following steps:

introducing into an engine control and management system a setpoint pressure for the chamber supplied by the pump, said setpoint pressure being higher than a theoretical maximum pressure for triggering the relief valve, successively measuring the pressure in the chamber, and storing in the memory, as the threshold pressure, a first measured pressure corresponding to a decrease in the pressure in comparison with a pressure measured during a previous pressure measurement.

14. The alerting method as claimed in claim 3, wherein under predetermined conditions the threshold pressure that is stored in the memory is determined, with the engine running, by performing the following steps:

introducing into an engine control and management system a setpoint pressure for the chamber supplied by the pump, said setpoint pressure being higher than a theoretical maximum pressure for triggering the relief valve, successively measuring the pressure in the chamber, and storing in the memory, as the threshold pressure, a first measured pressure corresponding to a decrease in the pressure in comparison with a pressure measured during a previous pressure measurement.

15. The alerting method as claimed in claim 4, wherein under predetermined conditions the threshold pressure that is stored in the memory is determined, with the engine running, by performing the following steps:

introducing into an engine control and management system a setpoint pressure for the chamber supplied by the pump, said setpoint pressure being higher than a theoretical maximum pressure for triggering the relief valve, successively measuring the pressure in the chamber, and storing in the memory, as the threshold pressure, a first measured pressure corresponding to a decrease in the pressure in comparison with a pressure measured during a previous pressure measurement.

16. The alerting method as claimed in claim 5, wherein under predetermined conditions the threshold pressure that is stored in the memory is determined, with the engine running, by performing the following steps:

introducing into an engine control and management system a setpoint pressure for the chamber supplied by the pump, said setpoint pressure being higher than a theoretical maximum pressure for triggering the relief valve, successively measuring the pressure in the chamber, and storing in the memory, as the threshold pressure, a first measured pressure corresponding to a decrease in the pressure in comparison with a pressure measured during a previous pressure measurement.

17. The engine control and management device as claimed in claim 8, wherein the alert is also triggered when a succession of a predetermined number of measurements each yield a pressure value increasing above the threshold pressure.

18. The engine control and management device as claimed in claim 8, wherein under predetermined conditions the threshold pressure that is stored in the memory upon cut-off of the engine is determined by the computer performing the following steps:

successively measuring the pressure of the fuel in the chamber, and storing in the memory, as the threshold pressure, a first measured pressure corresponding to a decrease in the pressure of the fuel in comparison with a measured pressure that is measured during a previous pressure measurement.

19. The engine control and management device as claimed in claim 18, wherein the predetermined conditions for determining the threshold pressure are as follows:

the pressure in the chamber is above a predetermined pressure, a temperature of an engine coolant is above a predetermined maximum temperature, a temperature of the chamber supplied by the pump is below a given minimum temperature, and an ambient temperature is above a predetermined ambient threshold temperature.

* * * * *